US008402571B1

(12) United States Patent
Pagett

(10) Patent No.: US 8,402,571 B1
(45) Date of Patent: Mar. 26, 2013

(54) TOILET SEAT HANDLE

(76) Inventor: Patrick Pagett, Thousand Oaks, CA (US)

( * ) Notice: Subject to any disclaimer, the term of this patent is extended or adjusted under 35 U.S.C. 154(b) by 0 days.

(21) Appl. No.: 13/526,903

(22) Filed: Jun. 19, 2012

(51) Int. Cl.
*A47K 13/10* (2006.01)

(52) U.S. Cl. ..... 4/246.1; 4/246.2; 4/246.3; 4/246.4; 4/246.5; 4/234; 292/125

(58) Field of Classification Search ..... 4/246.1, 4/246.3, 246.4, 246.5, 234; 292/256.5, 98, 292/128, 109, DIG. 11, 95, 121, 122, 125, 292/194, 219, 220, 225
See application file for complete search history.

(56) References Cited

U.S. PATENT DOCUMENTS

| | | | | |
|---|---|---|---|---|
| 203,713 | A * | 5/1878 | Fernandez | 126/212 |
| 723,973 | A | 3/1903 | Alexander | |
| 2,318,518 | A | 5/1943 | Opperer | |
| 3,191,193 | A | 6/1965 | Bogenberger | |
| 6,704,967 | B2 * | 3/2004 | Gianelli et al. | 16/422 |
| 6,842,916 | B1 | 1/2005 | Gunn et al. | |
| D507,168 | S | 7/2005 | Richard, Jr. | |
| 7,137,154 | B2 | 11/2006 | Miller | |
| 7,966,674 | B2 | 6/2011 | Olowofela | |
| 2011/0214226 | A1 * | 9/2011 | Dundas | 4/246.1 |

FOREIGN PATENT DOCUMENTS

| | | |
|---|---|---|
| EP | 1917892 | 5/2005 |
| EP | 1917892 A1 * | 5/2008 |
| JP | 3015362 | 8/1995 |

* cited by examiner

*Primary Examiner* — Gregory Huson
*Assistant Examiner* — Lauren Heitzer
(74) *Attorney, Agent, or Firm* — Cislo & Thomas, LLP

(57) ABSTRACT

A handle mechanism for lifting a toilet seat and its cover. The handle mechanism is affixed to the toilet seat cover, and selectively engages the toilet seat to lift the cover and the seat individually or together. Because the handle mechanism is affixed to the front of the cover, when the toilet is being used, with the seat up or down, the handle mechanism is well away from the toilet, such that the handle mechanism remains clean and sanitary.

16 Claims, 6 Drawing Sheets

TOILET SEAT HANDLE

BACKGROUND OF THE INVENTION

1. Technical Field

This invention relates to a device for lifting toilet seats in a sanitary manner, and more particularly to a novel handle attachable to the underside of the toilet seat cover so that the user may readily raise and lower the seat without touching the seat itself.

2. Background Art

Toilet seats are typically raised and lowered by manually grasping the edge and lifting or lowering the seat accordingly. The seat and its cover are generally hinged at their rear edge so that the seat and cover can be rotated about the hinge pins. Many toilet users are concerned with the sanitary aspects of touching a toilet seat. In their down and operational position, toilet seats are exposed to splashing of toilet water and human wastes, contact with various body parts, and the accompanying germs and bacteria.

Some attempts have been made to provide lifting means for such seats without touching the seat itself. Many of these devices are attached to the seat, and thus are exposed to the same splashing effect and body contact as the seat itself. Other devices have attached to the seat cover, while engaging the seat in some manner, but such devices lack adjustability for various shapes of seat covers, and further lack the ability to be easily removed for cleaning, while having an effective attachment mechanism that prevents dislodgement.

Therefore, a long standing need has existed to provide a novel means for raising and lowering a toilet seat without touching the seat or anything that is connected with the seat while in use, with sufficient adjustability for various models of toilet seats, and an attachment method that allows for both easy removal and substantial security.

The above problems and difficulties are obviated by the present invention which provides a novel means for raising and lowering the seat on a toilet bowl, which is pivotally attached thereto, that incorporates a handle having an attachment portion secured to the underside of the seat cover using both hook-loop fasteners and a snap button, and including a handle portion which extends outwardly from the front edge of the seat cover for grasping. The handle is equipped with attachment means that allows for adjustment to varying designs of toilets seats for nearly universal fit. The handle is movably coupled with the attachment means and a pulley mechanism, which pulley mechanism is in turn coupled with a latch to engage the toilet seat so that the toilet seat and toilet seat cover can be lifted simultaneously.

Thus, there is a need for a device that allows a user to lift a toilet seat using a sanitary handle, while at the same time keeping the sanitary handle away from the toilet bowl during use so that it remains sanitary.

BRIEF SUMMARY OF INVENTION

The present invention is directed to a handle mechanism for lifting a toilet seat and its cover. In a preferred embodiment, the handle mechanism is affixed to the underside of the front of a toilet seat cover, and selectively engages the toilet seat to lift the cover and the seat individually or together. Because the handle mechanism is affixed near the front of the cover, when the toilet is being used, with the seat up or down, the handle mechanism is well away from the toilet, such that the handle mechanism remains clean and sanitary.

The handle mechanism comprises a handle element with a portion that extends from the front of the toilet cover to provide a grasping surface for the handle mechanism, and another portion that extends underneath the toilet cover. The handle element is coupled with a latch element. A cradle element is adapted to receive the portion of the handle element that is underneath the toilet cover. A fixation element attaches the cradle to the toilet cover, a pulley element is attached to the cradle, and a pulley drive element is coupled with the handle element and the latch element. When the toilet cover is lowered, the latch element engages the underside of the toilet seat, so that when the handle element is lifted the toilet cover and seat are raised together. Thus, when the seat is raised, the handle mechanism is near the top of the toilet tank, well away from the toilet bowl, which keeps the handle mechanism from becoming soiled due to splashing, poor aim, and the like.

When the toilet cover is down and handle element is pulled, the latch element disengages from the toilet seat and the toilet cover may be raised by itself. Once again, during toilet use the handle mechanism is up near the top of the toilet tank so that it remains clean and sanitary.

The present invention is designed to keep the handle element clean and sanitary. The only time the handle mechanism is located close to the toilet is when the cover is closed and the toilet is incapable of being used. At that point, the only use of the toilet may be to flush it. With the cover closed, the grasping surface of the handle element protrudes between the seat and the cover. Thus, the seat would prevent any direct upward splashing from reaching the handle element, while the closed cover would prevent any indirect splashing from falling on top of the handle element. Therefore, it would take a very unusual circumstance for the grasping surface of the handle element to come into contact with any direct splashing from the toilet or its users.

The fixation element is comprised of industrial strength hook and loop fasteners, with a snap button embedded in the hook and loop fabric. This combination of a snap button and a hook and loop fastener provides a sturdy attachment apparatus that will not become dislodged by ordinary bumps, but is readily removable when desired.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
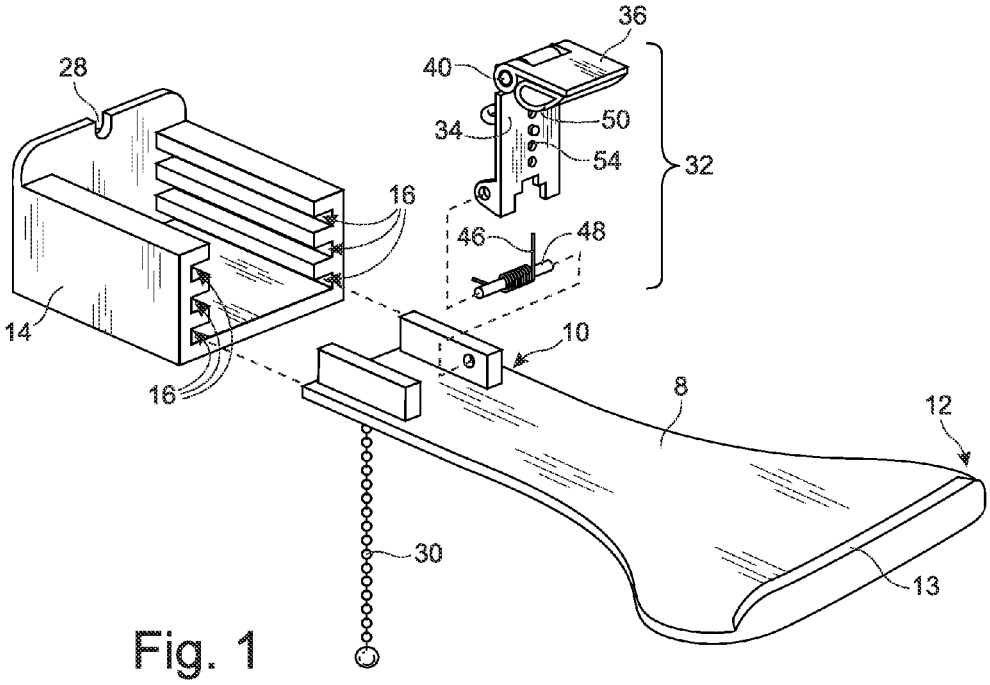
FIG. 1 is an exploded perspective view of the underside of an embodiment of the present invention.
Figure 2:
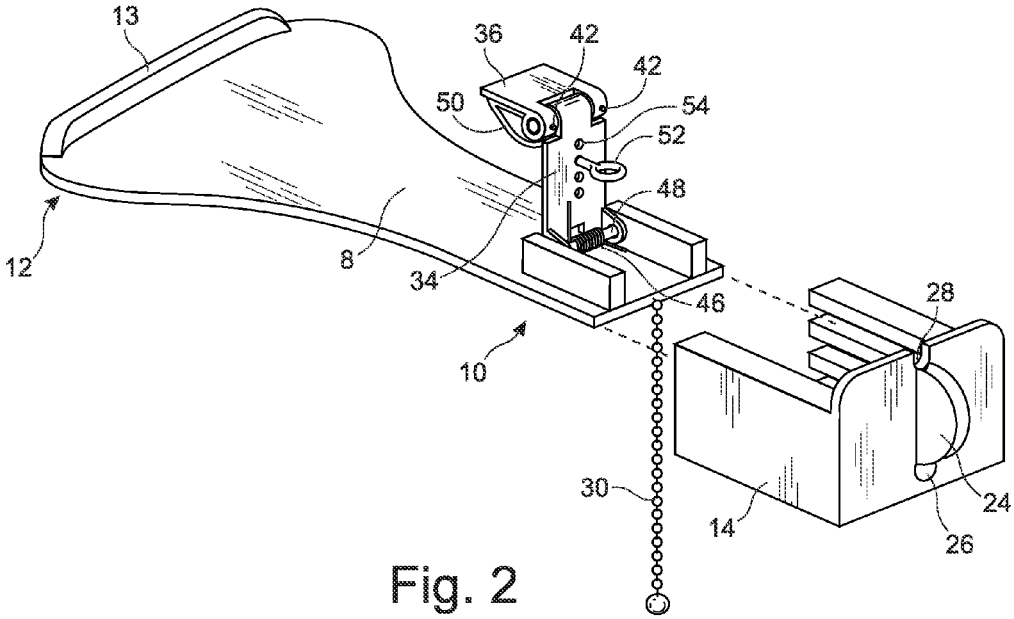
FIG. 2 is a perspective view of the embodiment shown in FIG. 1 from the opposite side.
Figure 3:
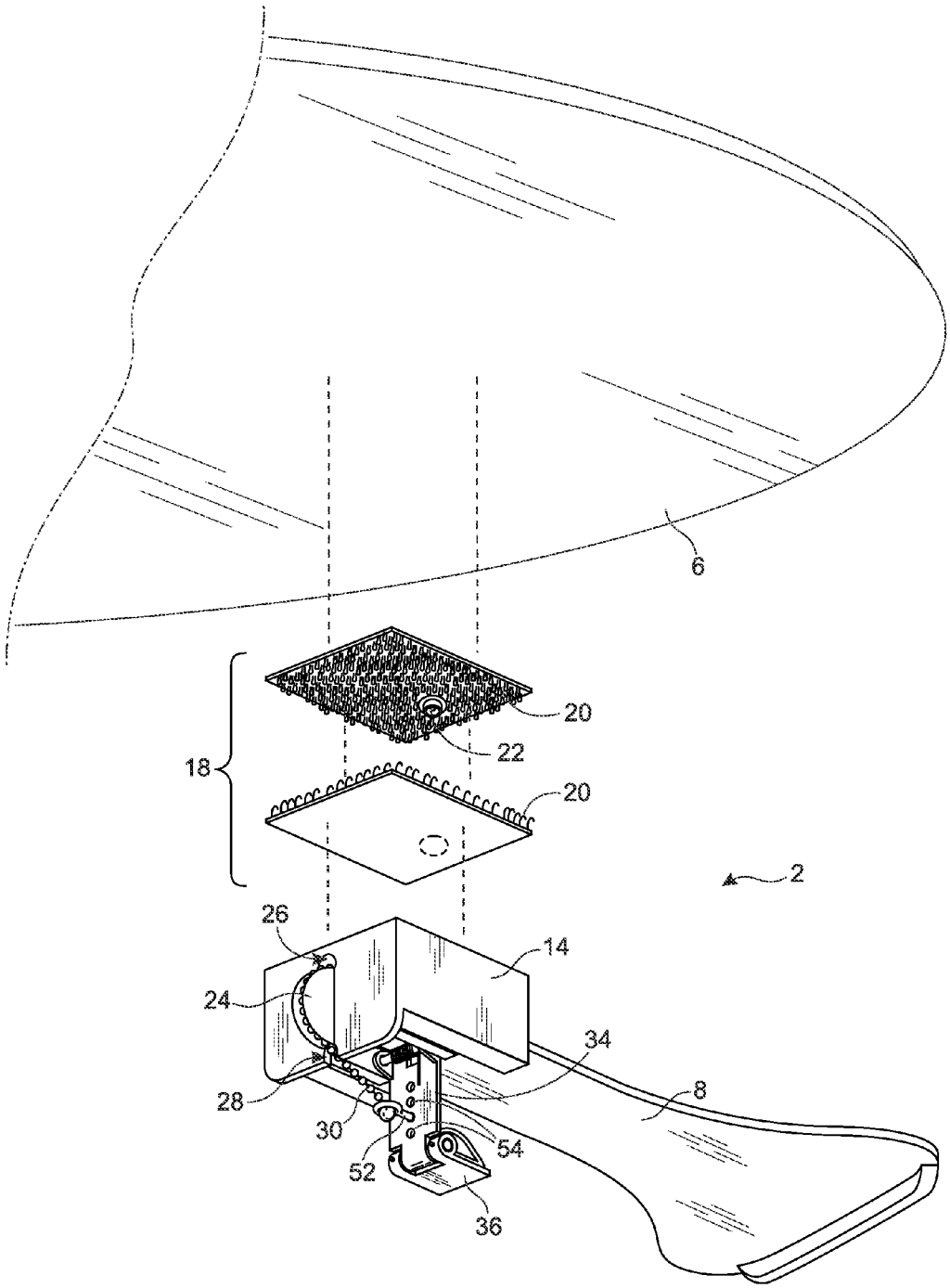
FIG. 3 is a perspective view of the underside of the embodiment shown in FIG. 1 also depicting a toilet seat cover and an exploded view of the fixation element.
Figure 4:
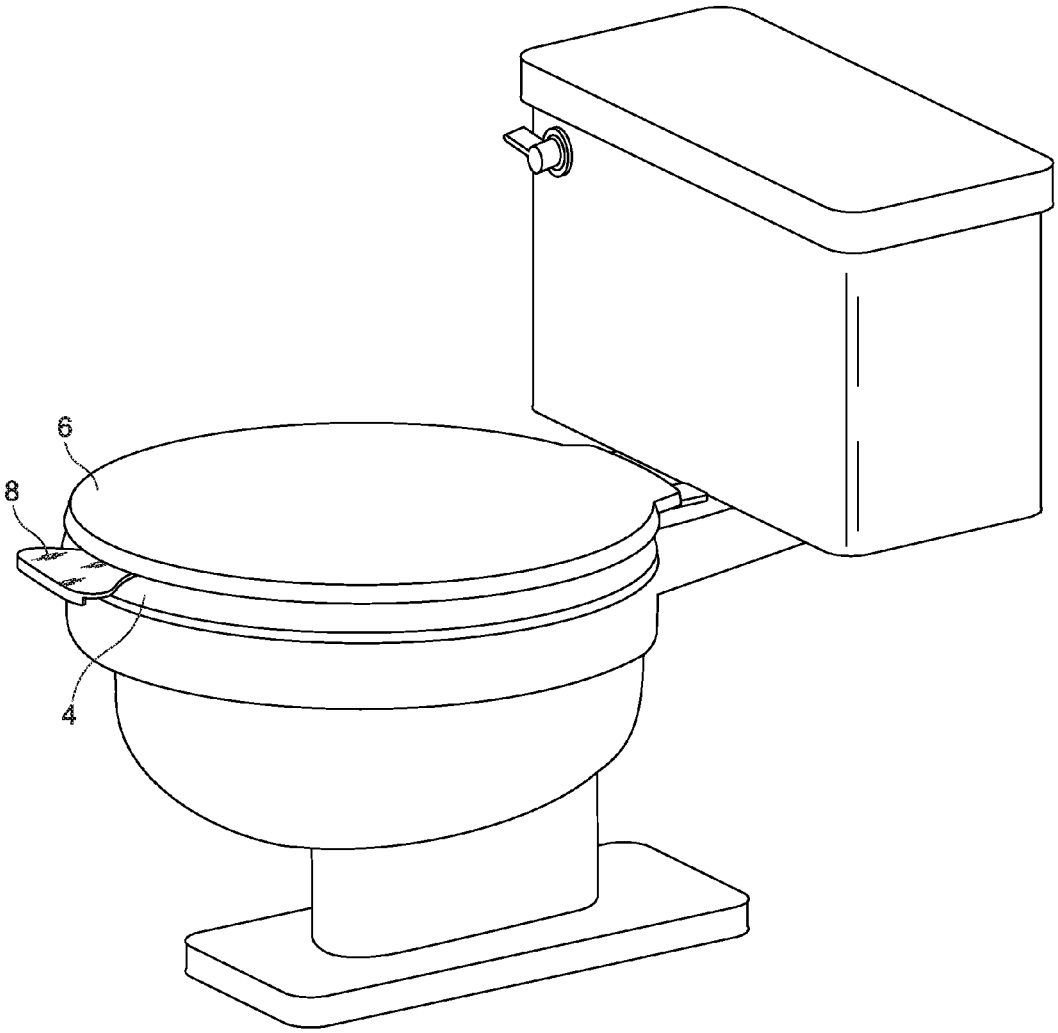
FIG. 4 is a depiction of an embodiment of the present invention as it would appear when mounted on a closed toilet cover.

As shown in FIGS. 1-3, a preferred embodiment of the present invention comprises a handle mechanism 2 for lifting a two-piece toilet seat having a toilet seat 4 and a toilet cover 6. The handle mechanism 2 comprises a handle element 8 that is preferably made of thermoplastic, acrylic, or other suitable lightweight, low-cost, high-impact material that can withstand the environment of a toilet seat. Such material should be non-corrosive, non-porous, and easy to sanitize. The handle element 8 may have two ends, distal 10 and proximal 12. When the handle mechanism 2 is mounted on a toilet seat cover 6, as shown in FIGS. 3-8, the proximal end 12 of the handle element 8 extends beyond the edge of the toilet cover 6 proximal to the user to act as a grasping surface, while the distal end 10 remains underneath the toilet cover 6.

The proximal end 12 of the handle element 8 may have a variety of shapes adapted to act as a grasping surface. In a preferred embodiment it may have a broad, flat shape with a small lip 13, but may have many other suitable shapes. The proximal end 12 may have logos, advertising, or other symbols or words, including instructions for use. The proximal end 12 may also be constructed of, and/or be coated with, a luminescent material that glows in the dark, to assist a user in finding the handle in a dark restroom. The proximal end 12 could even be fitted with a small light, such as an LED with a small battery and a photocell, to light the handle at night.

The handle element 8 is fitted inside a cradle 14. As shown in FIGS. 1 and 2, the cradle 14 is adapted to receive the distal end 10 of the handle element 8. In a preferred embodiment, the cradle 14 is adapted to slidably receive the distal end 10 of the handle. Such adaptations may take the form of slots 16 to receive a planar distal end 10 of the handle element 8, or could be any variety of suitable male and female parts that are adapted to receive each other, such as rails, tongue and groove, and the like.

The cradle 14 is adapted to couple with a toilet cover 6 via a fixation element 18. In a preferred embodiment, shown in FIG. 3, the fixation element 18 may comprise industrial-strength hook and loop fasteners 20, such as Velcro®. The hook and loop fasteners 20 may also be equipped with a snap fastener or snap button 22, commonly used on clothing. The snap button 22 may be embedded into the Velcro® fabric. The combination of the hook and loop 20 and snap button 22 tend to provide increased fastening power over their individual use. Such increased fastening power may be useful in retaining the cradle 14 on the toilet cover 6 while the handle element 8 is bumped and jostled by users, but allowing the handle mechanism 2 to be removed when necessary or desired, such as when cleaning the toilet.

Other fixation elements could be utilized to fasten the cradle 14 to the toilet cover 6. These might include screws, adhesives, tape, slots, or other suitable fastening mechanisms. Alternatively, the cradle 14 could be molded directly into the toilet cover 6.

Modern toilet covers have a wide variety of shapes, and many are not flat. As shown in FIGS. 1 and 2, the cradle 14 may have a plurality of slots 16 that are adapted to receive the distal end 10 of the handle element 8 to provide a height adjustment of the handle element 8 to accommodate a variety of toilet cover configurations. Although the slots 16 are shown to hold the flat distal end 10 of the handle element 8, those skilled in the art will appreciate that a wide variety of configurations could be used. The plurality of slots 16 in the cradle 14 allows the handle element 8 to be placed at the appropriate elevation so that the handle element 8 does not contact and/or bind on the toilet seat 4 and/or the toilet cover 6.

As shown in FIGS. 2 and 3, the cradle 14 is equipped with a pulley element 24, which, in a preferred embodiment, is a half-circle with a groove and two outside flanges. Adjacent to the top and bottom sides of the pulley there is a corresponding top opening 26 and a bottom opening 28 in the cradle 14. These openings accommodate a pulley drive element 30 that is routed around the pulley element 24. Depending on the configuration of the cradle 14, these openings could encircle the pulley drive element 30 or could be open.

A latch element 32 may be hingably coupled via a hinge 38 with the handle element 8. In a preferred embodiment shown in FIGS. 1 and 2, the latch element 32 is comprised of two sub-elements, an upright 34 and a hook 36. The upright 34 is hingably coupled via a hinge 48 with the underside of the handle element 8, and is configured at a relatively acute angle along its length to the underside of the handle element 8, and may be spring-loaded to bias it towards the proximal end 12 of the handle. On the bottom portion of the of the latch element 32 is a hook 36, which may be hingably attached via hinge 40 to the upright 34, and the hook 36 may be spring loaded to bias it downwards, away from the handle element 8 and away from the cradle 14. In a preferred embodiment, the hook 36 is equipped with stops in the hinge area to keep it from rotating too far, as the stops engage the upright 34 to stop the rotation of the hook 36. Although the stops are shown as protrusions 42 on the hinge knuckle, they may be formed into the knuckle itself, or the hinge could have corresponding knuckles that prevent over-rotation of the hinge, or any other suitable apparatus for limiting the ability of the hinge to open past a prescribed point.

Two types of spring loading are shown in FIGS. 1 and 2. The upright 34 is shown with a standard coil spring 46 around a pivot bar 48. The hook 36 is shown with a hollow, resilient rubber or vinyl tube 50, similar to those used in door gaskets. This tube 50 is flexible, to allow the hook 36 to fold towards the upright 34, but is resilient to spring back into shape when pressure is released. The tube 50 also acts as a cushion for when the hook 36 engages the toilet seat, as explained below and shown in FIG. 5. Despite the advantage of the tube 50 on the hook 36, the tube 50 is not required, and the hook 36 may be spring loaded with a standard coil spring or other suitable biasing mechanism. Although these two types of spring loading are shown and described, those skilled in the art will appreciate that other types of spring loading or biasing may be used.

As shown in FIGS. 2 and 3, the upright 34 of the latch element 32 may be equipped with a retention element 52. As shown in FIGS. 1, 2, 3, and 5, a pulley drive element 30 may be coupled at a first end with the distal portion 10 of the handle element 8, and coupled at a second end with the latch element 32 via the retention element 52 that is coupled with the upright 34. The upright 34 may be equipped with holes 54 or slots to allow the retention element 52 and/or the hook 36 to be adjusted. The retention element 52 may comprise a screw eye with a machine thread and one or more nuts to secure it to the upright 34 and/or hook 36. The upright 34 and/or hook 36 may be equipped with one or more holes 54 or slots so that the height of the hook 36 and/or retention element 52 may be adjusted by placing the threaded portion of the screw eye in the appropriate hole or at the appropriate location on the slot, or a combination thereof, and securing the nut(s) onto the screw threads. As will be appreciated by those skilled in the art, various other securing and/or adjustment apparatus could be used.

As shown in FIG. 3, the middle portion of the pulley drive element 30 may be routed around the pulley element 24, and the two ends are respectively routed through the top opening 26 and the bottom opening 28 in the cradle 14. The pulley drive element 30 is shown in the Figures as a ball chain, which allows for easy adjustability of its length to customize and/or adjust the handle mechanism 2 to engage or disengage the toilet seat, as discussed below. The length of a ball chain is easily adjusted by changing the position of the coupler or connector to a different ball on the chain. But the pulley drive element 30 could be any type of wire, cable, string, or other material that has sufficient tensile strength and resistance to stretch to effectively operate the handle mechanism, while flexible enough to bend and travel around the pulley element 24. Adjustment of the pulley drive element 30 may or may not be necessary or desired.

Figure 9:
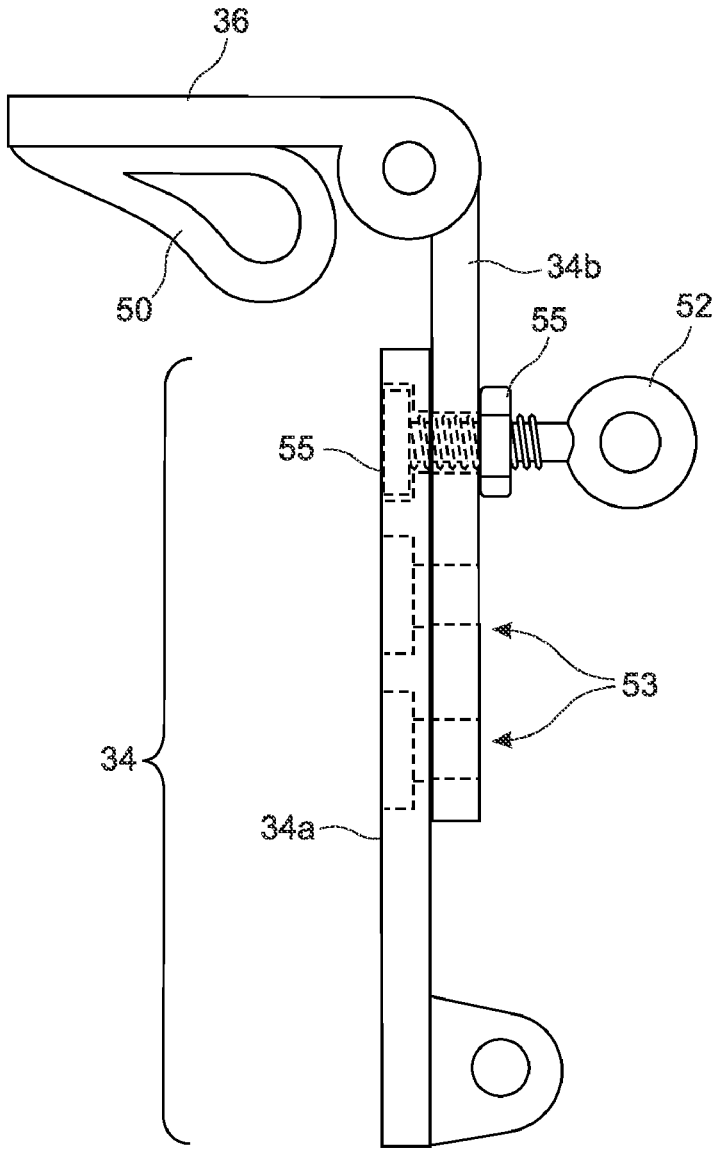
FIG. 9 is a side view of another embodiment of the upright.

In another embodiment, the upright 34 may comprise more than one piece. As shown in FIG. 9, the upright may have two portions, 34*a* and 34*b*. The upright 34*a* attaches to the handle element 8, while upright 34*b* attaches to the hook 36. A retention element 52 may comprise a screw eye with a machine thread, the threaded portion inserted through holes 53 (shown by dashed lines in FIG. 9) in uprights 34*a* and 34*b*, with nuts 55 on either side of the upright 34*a* and 34*b* to secure the retention element 52. In some embodiments, the nut 55 may be inside the hole 53 of upright portion 34*a*. The uprights 34*a* and 34*b* may have one or more holes in them, in any combination, to allow the height of the upright 34 to be adjusted. Either upright 34*a* or 34*b*, or both, could be equipped with a protrusion that would match the holes in the corresponding upright portion, to increase the stability of the upright 34. The nuts and retention element could be other shapes and hardware, as would be chosen by one of ordinary skill in the art.

Figure 5:
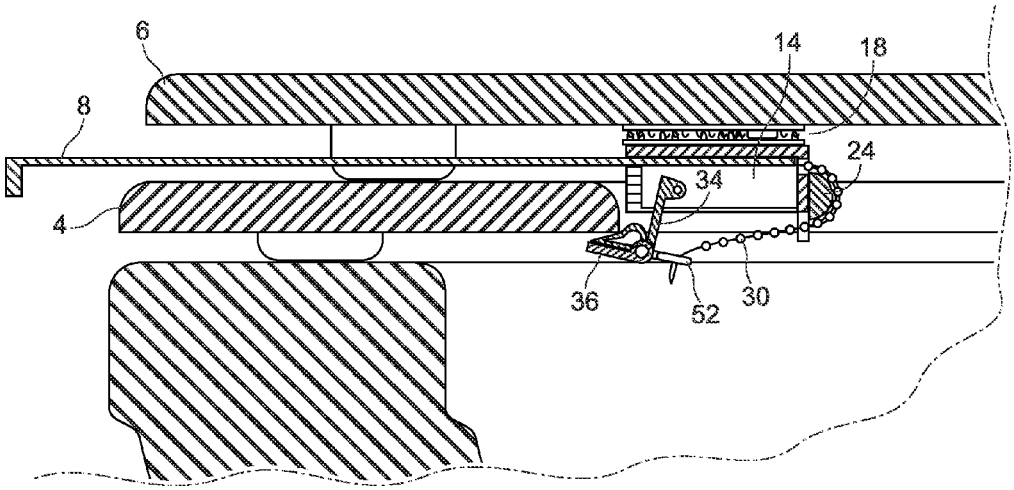
FIG. 5 is a cross section view from the side of a toilet of an embodiment of the present invention mounted on a toilet cover and engaging a toilet seat.
Figure 6:
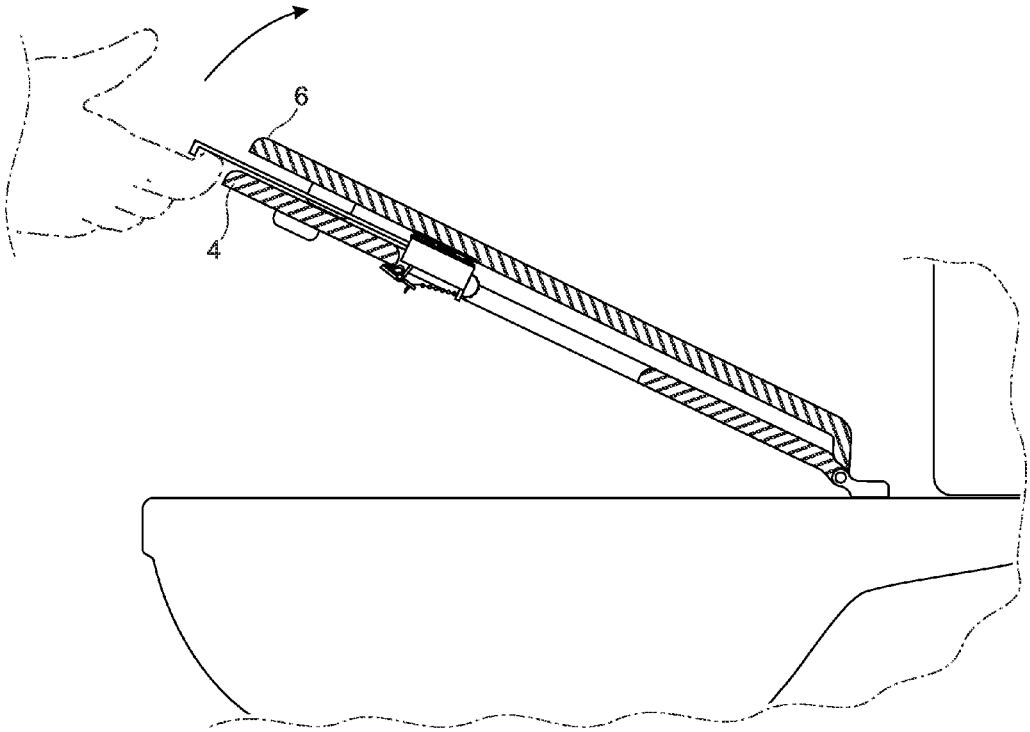
FIG. 6 is a cross section view of the embodiment shown in FIG. 5 and depicting how the invention can be used to lift both the toilet seat and toilet cover.

In operation, a preferred embodiment of the handle mechanism 2 is mounted to the underside of a toilet cover 6 by fastening the adhesive side of the industrial Velcro® hook and loop fastener fixation element 18 to the toilet cover 6. Preferably this would be the "hook" side of the hook and loop fastener 20, as the hooks are a bit easier to clean than the "loop" side, and thus the "hook" side is better to leave fastened to the toilet cover 6 when the handle mechanism 2 is removed. The corresponding portion of the hook and loop fastener 20 is fastened via its adhesive to the top portion of the cradle 14. Each side of the hook and loop fastener 20 is further equipped with a snap fastener 22. The snap fasteners 22 are aligned and the two sides of the hook and loop fastener 20 are pushed together, securing the hook and loop fastener 20 and the snap fastener 22. The user may then align the handle element's distal portion with the slots 16 in the cradle 14 so that the proximal portion of the handle element 8 protrudes from the edge of the toilet cover 6. The user may select the appropriate slot in the cradle 14 to allow the handle element 8 to be placed at the appropriate elevation so that the handle element 8 does not contact and/or bind on the toilet seat 4 and/or the toilet cover 6 when the toilet cover 6 is down. The pulley drive element 30 is attached to the distal portion of the handle element 8, and the user then routes the pulley drive element 30 around the pulley element 24 and connects the second end of the pulley drive element 30 to the retention element 52 that is coupled with the upright 34 of the latch element 32. When the toilet cover 6 is lowered onto the seat, the top of the toilet seat 4 touches the bottom portion of the hook 36, which pivots on its hinge to swing out of the way while the toilet cover 6 is further lowered and the hook 36 is moved past the toilet seat. The spring loading in the upright 34 and handle element pivot may also assist in moving the hook 36 sufficiently out of the way to clear the toilet seat. Once the toilet cover 6 is fully lowered, the hook 36 clears the toilet seat 4 and its spring loading pushes the hook 36 downwards, below the toilet seat. Thus, when the proximal portion of the handle element 8 is lifted, the hook 36 will engage the bottom of the toilet seat, and lift the toilet seat 4 and toilet cover 6 together, as shown in FIGS. 5 and 6. In other words, when the toilet cover 6 is lowered onto the toilet seat 4, the latch element 32 engages the underside of the toilet seat 4 and the toilet cover 6 can be lifted together by holding only the proximal end 12 of the handle element 8. The spring loading or biasing of the latch element 32 keeps the latch element 32 engaged to the underside of the toilet seat 4 until the user pulls the handle element 8 outward, as explained below.

Figure 7:
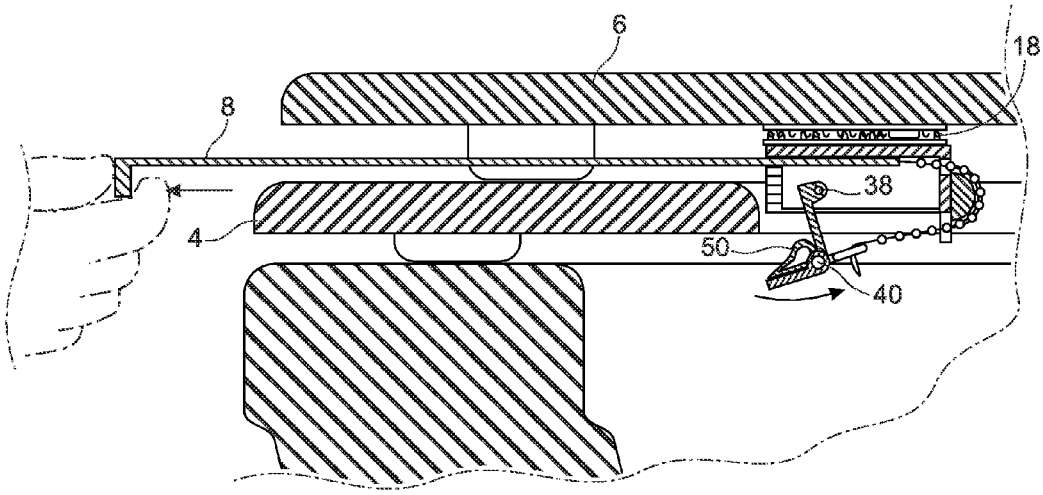
FIG. 7 is a cross section view of the embodiment shown in FIG. 5 and depicting how the invention is disengaged from the toilet seat.
Figure 8:
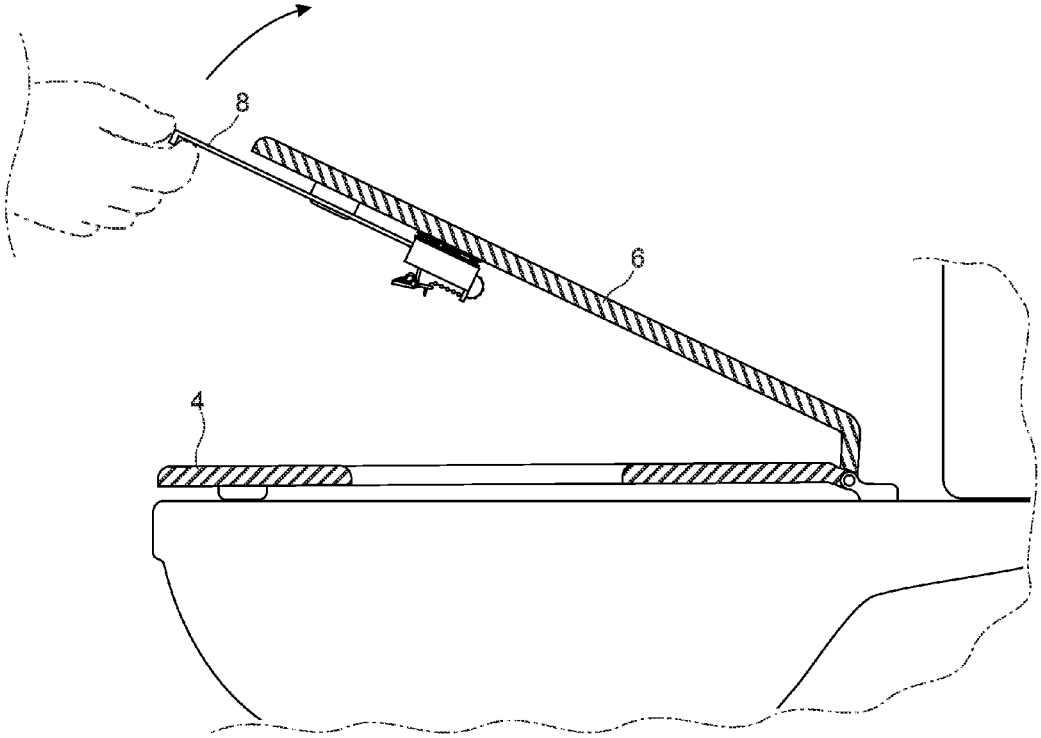
FIG. 8 is a cross section view of the embodiment shown in FIG. 5 and depicting how the invention can be used to lift the toilet cover alone.

In further operation of a preferred embodiment, when the toilet cover 6 is down and the user wants to lift the toilet cover 6 alone, he or she operates the handle mechanism 2 as follows. As shown in FIGS. 7 and 8, the user pulls on the proximal end 12 of the handle element 8, which in turn pulls the pulley drive element 30, which in turn pulls on the retention element 52 that is coupled with the latch element 32 (comprising the hook 36 and upright 34), pulling the hook 36 clear of the toilet seat 4 so that the toilet cover 6 can be lifted alone. Thus, pulling on the proximal end 12 of the handle element 8 away from the toilet cover 6 and toilet seat 4 causes the pulley drive element 30 to pull the latch element 32 away from the underside of the toilet seat 4, thus disengaging the toilet seat 4 from the handle mechanism.

Alternatively, the latch element 32 may not be spring loaded or biased. The handle mechanism 2 may be operated manually, so that when the handle element 8 is pushed in, the latch element 32 engages the toilet seat 4. The handle element 8 would then have to be pulled out to disengage the toilet seat 4. The handle element 8 could operate freely so that its movement is not encumbered. Alternatively, there could be a friction or detent mechanism built into at least one of the elements so that the latch element 32 is held in place until the user moves the proximal end 12 of the handle element 8 to change the position. Such friction or detent mechanism would keep the latch element 32 engaged or disengaged with the toilet seat 4 when the user releases the handle element 8, as opposed to the handle element 8 or other elements moving due to their own weight or movement of the toilet seat 4 or cover.

In an alternative embodiment, the hook 36 could be disengaged with the toilet seat 4 by pushing on the proximal end 12 of the handle element 8. This could be accomplished by directly coupling the handle element 8 to the latch element 32, eliminating the direction-reversing pulley element 24 and pulley drive element 30. The handle element 8 and/or latch element 32 could be spring loaded, biased toward the proximal end 12 of the handle element 8, or they could be held in place by friction, detents, or other suitable mechanical apparatus.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A handle mechanism for lifting a toilet seat and a toilet cover, comprising:

a. a handle element with two ends, a distal end underneath the toilet cover and a proximal end protruding out and away from the toilet cover, wherein the handle glows in the dark;

b. a cradle adapted to receive the distal end of the handle element, wherein the cradle comprises a plurality of slots arranged in parallel planes into which the distal end of the handle element can be inserted to adjust an elevation of the handle element relative to the toilet seat;

c. a fixation element having a first side adapted to attach to an underside of the toilet cover, and a second side adapted to attach to the cradle, wherein the first side of the fixation element comprises a snap button embedded in a hook and loop fastener and the second side of the fixation element comprises the corresponding portions of the snap button and hook and loop fastener;

d. a pulley element coupled with the cradle adjacent to the distal end of the handle element;

e. a latch element hingably coupled with the handle element, the latch element comprising a hook to engage the underside of the toilet seat, the hook biased away from the cradle, and wherein the latch element is biased towards the proximal end of the handle; wherein the latch element comprises a retention element, wherein the retention element is adjustable along the latch element;

f. a pulley drive element with two ends and a middle portion, a first end coupled with the distal end of the handle element, a second end coupled with the retention element of the latch element, and the middle portion routed around the pulley element, wherein when the toilet cover is lowered onto the toilet seat, the latch element engages the underside of the toilet seat and the toilet, cover can be lifted together by holding only the proximal end of the handle element, and further wherein pulling on the proximal end of the handle element away from the toilet cover and toilet seat causes the pulley drive element to pull the latch element, away from the underside of the toilet seat, this disengaging the toilet seat from the handle mechanism.

2. A handle mechanism for lifting a toilet seat and a toilet cover, comprising;

a. a handle element with two ends, a distal end underneath the toilet cover and a proximal end protruding out and away from the toilet cover;

b. a cradle adapted to receive the distal end of the handle element;

c. a fixation element having a first side adapted to attach to an underside of the toilet cover, and a second side adapted to attach to the cradle;

d. a pulley element coupled with the cradle adjacent to the distal end of the handle element;

e. a latch element hingably coupled with the handle element, the latch element adapted to engage an underside of the toilet seat;

f. a pulley drive element with two ends and a middle portion, a first end coupled with the distal end of the handle element, a second end coupled with the latch element, and the middle portion routed around the pulley element, wherein when the toilet cover is lowered onto the toilet seat, the latch element engages the underside of the toilet seat and the toilet cover can be lifted together by holding only the proximal end of the handle element, and further wherein pulling on the proximal end of the handle element away from the toilet cover and toilet seat causes the pulley drive element to pull the latch element away from the underside of the toilet, seat, thus disengaging the toilet, seat from the handle mechanism.

3. The handle mechanism of claim wherein the cradle comprises a plurality of slots arranged in parallel planes into which the distal end of the handle element can be inserted to adjust an elevation of the handle element relative to the toilet seat.

4. The handle mechanism of claim 2, wherein the latch element is biased towards the proximal end of the handle.

5. The handle mechanism of claim 2, wherein the latch element comprises a hook to engage the underside of the toilet seat, the hook element biased away from the cradle.

6. The handle mechanism of claim 2, wherein the fixation element comprises a snap button embedded in a hook and loop fastener.

7. The handle mechanism of claim 2, wherein the handle element glows in the dark.

8. The handle mechanism of claim 2, wherein the latch element comprises a retention element to which the pulley drive element is coupled, wherein the retention element is adjustable along the latch element.

9. A handle mechanism for lifting a toilet seat and a toilet cover, comprising;

a. a handle element with two ends, a distal end underneath the toilet cover and a proximal end protruding out and away from the toilet cover;

b. a cradle adapted to receive the distal end of the handle element;

c. a fixation element having a first side adapted to attach to an underside of the toilet cover, and a second side adapted to attach to the cradle;

d. a latch element hingably coupled with the handle element, the latch element adapted to engage an underside of the toilet seat, wherein movement of the handle element in a first direction disengages the latch element from the underside of the toilet seat, and wherein movement of the handle element in a second direction re-engages the latch element to the underside of the toilet seat;

e. a pulley element coupled with the cradle adjacent to the distal end of the handle element; and f. a pulley drive element with two ends and a middle portion, a first end coupled with the distal end of the handle element, a second end coupled with the latch element, and the middle portion routed around the pulley element, such that movement of the handle element in the first direction causes the latch element to disengage from the toilet seat.

10. The handle mechanism of claim 9, wherein a spring mechanism moves the handle element in the second direction automatically when the handle element is released.

11. The handle mechanism of claim 9, wherein the cradle comprises a plurality of slots arranged in parallel planes into which the distal end of the handle element can be inserted to adjust an elevation of the handle element relative to the toilet seat.

12. The handle mechanism of claim 9, wherein the latch element, is biased towards the proximal end of the handle.

13. The handle mechanism of claim 9, wherein the latch element comprises a hook to engage the underside of the toilet seat, the hook element biased away from the cradle.

14. The handle mechanism of claim 9, wherein the fixation element comprises a snap button embedded in a hook and loop fastener.

15. The handle mechanism of claim 9, wherein the handle element glows in the dark.

16. The handle mechanism of claim 9, wherein the latch element comprises a retention element to which the pulley drive element is coupled, wherein the retention element is adjustable along the latch element.

* * * * *